United States Patent [19]

Marcoux et al.

[11] Patent Number: 4,757,165

[45] Date of Patent: Jul. 12, 1988

[54] DUAL CONDITION RESPONSIVE ELECTRICAL SWITCH

[75] Inventors: Leo Marcoux, Rehoboth; Benjamin A. Barber; Lawrence E. Cooper, both of Attleboro, all of Mass.; Carlton E. Sanford, E. Providence, R.I.

[73] Assignee: Texas Instruments Incorporated, Dallas, Tex.

[21] Appl. No.: 114,487

[22] Filed: Oct. 28, 1987

Related U.S. Application Data

[63] Continuation-in-part of Ser. No. 946,438, Dec. 23, 1986, abandoned.

[51] Int. Cl.[4] ..... H01H 35/34

[52] U.S. Cl. ..... 200/83 P; 337/343; 200/83 J

[58] Field of Search ..... 200/83 Y, 83 W, 83 R, 200/83 J, 83 P, 302.1, 81.4, 81.5; 337/343; 91/1; 92/5 R, 98 R, 101; 73/861.47, 717, 723; 340/626; 307/118

[56] References Cited

U.S. PATENT DOCUMENTS

| | | | |
|---|---|---|---|
| 4,400,601 | 8/1983 | Brucken | 200/83 W |
| 4,581,509 | 4/1986 | Sanford | 200/83 P |
| 4,591,677 | 5/1986 | Hirota | 200/83 P |

*Primary Examiner*—G. P. Tolin

*Attorney, Agent, or Firm*—John A. Haug; James P. McAndrews; Melvin Sharp

[57] ABSTRACT

A dual condition responsive switch is shown including first and second discs each having convex-concave surface configurations on opposite sides thereof adapted to invert its configuration upon being subjected to selected conditions. A motion transfer member extends from the second disc to an electric switch. At a first range of conditions the first disc prevents actuation of the switch, at a second range of conditions the curvature of the first disc has inverted allowing actuation of the switch while at a third range of conditions the curvature of the second disc has inverted resulting in deactuation of the switch.

26 Claims, 5 Drawing Sheets

DUAL CONDITION RESPONSIVE ELECTRICAL SWITCH

This is a continuation-in-part of Ser. No. 06/946,438 filed Dec. 23, 1986, now abandoned.

BACKGROUND OF THE INVENTION

This invention relates generally to electrical switches and more particularly to switches using spring disc elements which move between opposite convex and concave configurations and which are actuated upon the occurrence of selected conditions such as pressure or temperature.

Conventional condition responsive switches have a contact arm movable between first and second switch positions prebiased to one switch position and have a dished snap acting disc element movable between opposite convex and concave configurations for moving the switch between switch positions in response to the occurrence of selected temperature or pressure conditions. Such switches are intended to perform selected control functions in response to the occurrence of the selected temperature or pressure conditions in a zone to be monitored. An example of a switch of this type is shown and described in U.S. Pat. No. 4,581,509 which issued to the assignee of the present invention.

This type of switch has become widely used, among other applications, in automotive environments such as in the air conditioning refrigeration compressor systems. For example there is a need in such a system to provide a switch to protect the system from excessive high pressure. Additionally, there is a need to provide a switch to protect the system from a loss of freon and lubricant charge and resulting compressor damage. Both of these switches are connected to operate the compressor clutch either directly or through a computer control system. Both switches are typically mounted in the compressor housing and communicate with the high pressure side of the system. The high pressure protection device typically opens on pressure increase to about 430 psi while the high side low pressure switch typically closes on pressure increase to 50 psi.

It is an object of the present invention to provide apparatus which provides both of the above functions in a single housing. Another object of the invention is the provision of a switch apparatus for dual functions which employs fewer parts than prior art switches and which also saves on installation cost and space required for such installation.

Briefly, in accordance with the invention a normally open electric switch is mounted adjacent first and second vertically aligned discs adapted to move from one dished configuration to an opposite dished configuration upon the occurrence of selected conditions. According to a feature of the invention the first disc is disposed in a first disc receiving chamber and has a normally concave surface configuration facing the switch. The first disc has a centrally disposed aperture through which a motion transfer pin extends between a movable contact arm of the electric switch and the second disc disposed in a second disc receiving chamber. The second disc has a normally convex surface configuration facing toward the switch and is mounted in a pressure-force converter which is adapted to move the second disc toward a reaction surface. A motion transfer member is placed between the two discs. The first disc is adapted to invert its curvature upon being exposed to increasing pressures of a selected first level or above, and the second disc is adapted to invert its curvature upon being exposed to increasing pressures of a selected second, higher level or above. At pressures below the first level, the first disc prevents actuation of the switch and at pressures above the second level the second disc allows deactuation of the switch.

Alternative embodiments use a floating ring to transfer motion between the discs and provides a reaction surface for the second disc.

Another embodiment disposes the first and second discs in direct engagement with one another.

BRIEF DESCRIPTION OF THE DRAWINGS

Other objects, advantages and details of the condition responsive device of this invention appear in the following detailed description of preferred embodiments of the invention, the detailed description referring to the drawings in which.

Figure 1:
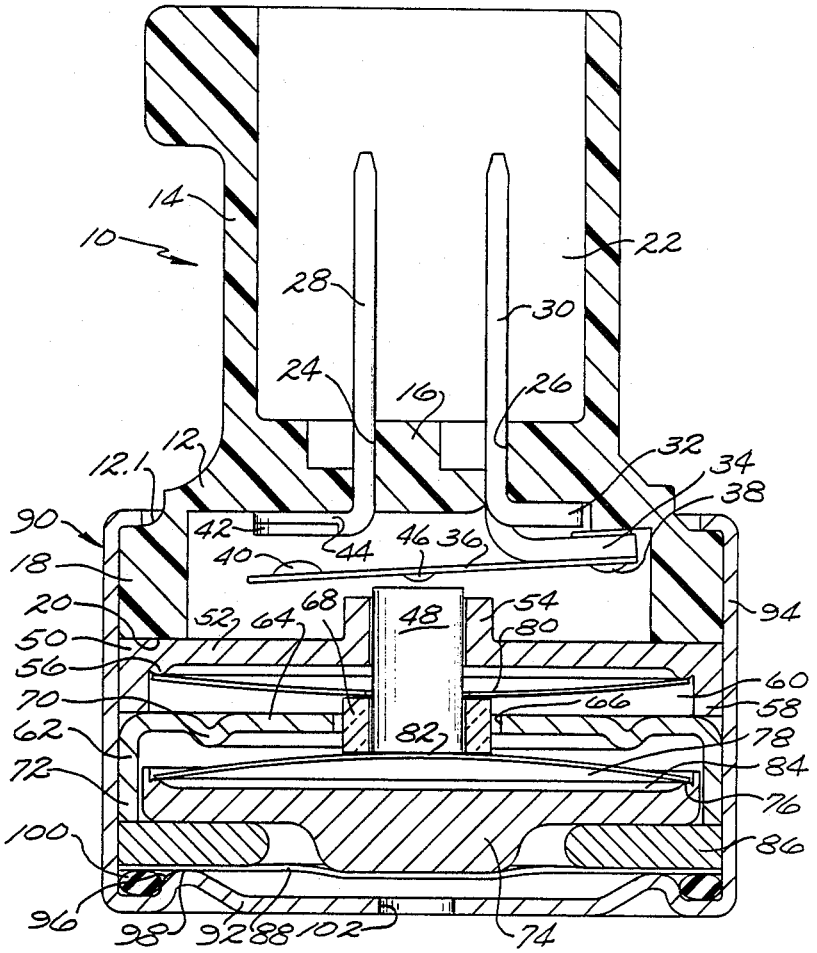
FIG. 1 is a sectional view along the longitudinal axis of a switch in the open contacts position made in accordance with the invention, the discs shown in configurations reflecting that the pressure to which the device is exposed is below a first selected level with respect to increasing pressure or below a fourth selected level with respect to decreasing pressure.

Dimensions of certain of the parts as shown in the drawings may have been modified to illustrate the invention with more clarity.

Corresponding reference characters indicate corresponding parts throughout the several views of the drawings.

DESCRIPTION OF PREFERRED EMBODIMENTS

Figure 2:
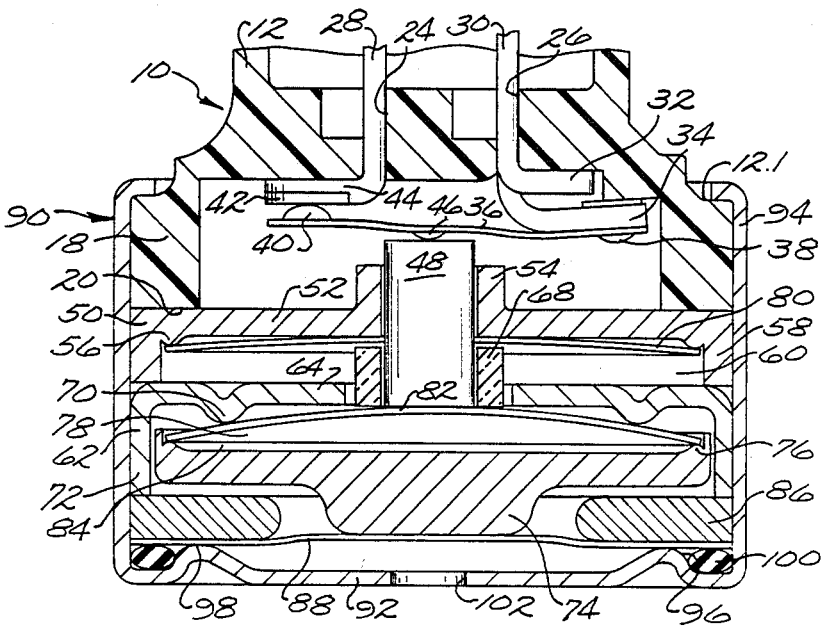
FIG. 2 is a section similar to FIG. 1 with the top portion being broken away to conserve room, the switch shown in the contacts engaged position allowing energization of the system which it monitors such as the air conditioning system referenced supra, and the discs shown in configuration reflecting that the pressure level is between selected first and second levels with respect to increasing pressure or between selected third and fourth levels with respect to decreasing pressure.
Figure 3:
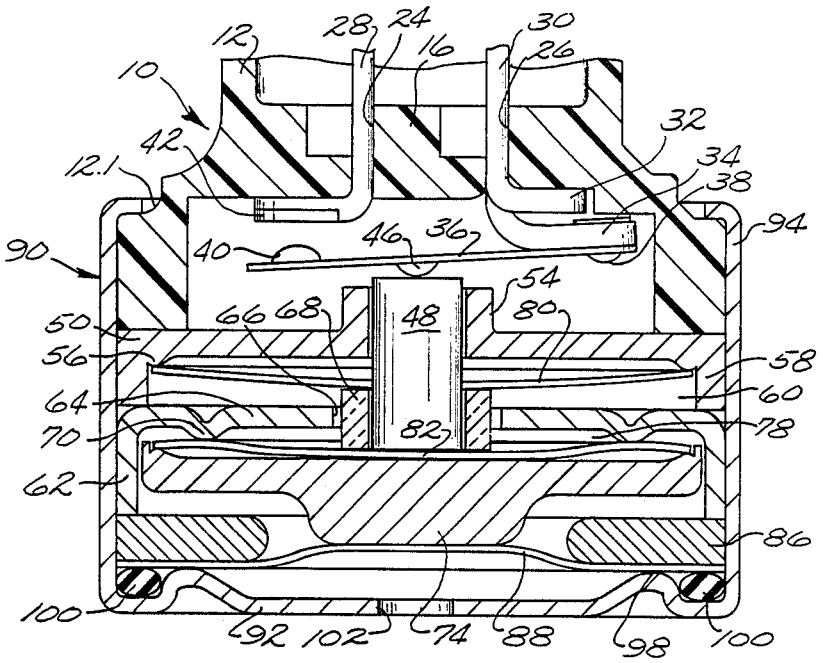
FIG. 3 is a sectional view similar to FIG. 2 showing the switch in the open contacts position deenergizing the system, the discs shown in configurations reflecting that the pressure level is as high as or higher than the selected second pressure level with respect to increasing pressure or higher than a selected third level with respect to decreasing pressure.

Referring to the drawings, numeral 10 in FIGS. 1–3 indicates a dual condition responsive device made in accordance with the invention which includes a base 12 preferably molded in one piece using a suitable rigid electrically insulative material such as glass filed nylon or the like. The base preferably has a cylindrical configuration including a cylindrical intermediate part 14, a bottom wall 16 and cylindrical side wall 18 which has a flat distal mounting surface 20. Intermediate part 14 is formed with a hollow portion 22 to form a terminal enclosure. Bottom wall 16 is provided with first and second apertures 24 and 26 and receive therethrough terminal members 28 and 30 respectively. Terminal 30 has a shelf 32 received on wall 16 and a platform 34 spaced below wall 16 and extending away from terminal 28. A flexible, electrically conductive movable contact arm 36 formed of material having good spring characteristics such as betyllium copper of the like is mounted on platform 34 in cantilever fashion by suitable means such as rivet 38. A movable contact 40 of suitable contact material is mounted on the free distal end of arm 36 in any conventional manner such as by welding and is adapted to move into and out of circuit engagement with a stationary contact 42 mounted on a shelf 44 of terminal 28 received on wall 16. Contact 42 formed of suitable contact material is shown as an inlaid portion of shelf 44 however the contact could be separately attached if desired. A dimple 46 is preferably formed in movable arm 36 to provide more uniform motion transfer characteristics from a motion transfer pin 48 to be described below.

A first metallic disc element support and motion transfer pin guide member 50 is received on the flat distal surface 20 of base 12 and comprises a generally circular wall 52 with a centrally disposed upwardly extending wall 54 forming a bore adapted to slidingly receive motion transfer pin 48. An annular disc seat 56 is formed in the lower portion of wall 52 with a downwardly extending wall 58 forming a first disc receiving chamber 60.

A second metallic disc element support 62 is received on the end of wall 58 and comprises a generally circular wall 64 with a centrally disposed aperture 66 adapted to receive therethrough transfer pin 48 as well as an annular motion transfer member 68 to be discussed below. An annular force reaction ridge 70 is formed in wall 64 and is adapted to engage a snap acting disc as described below. Second disc element support 62 is also provided with a downwardly extending wall 72 which slidingly receives a pressure converter 74 formed with a disc receiving seat 76 in its top surface adjacent the outer periphery of the converter in a second disc receiving chamber 78.

As shown in FIG. 1, a first disc 80 having a centrally disposed aperture to accommodate motion transfer pin 48 and having an upwardly concave surface configuration at pressures below a first pressure level with respect to increasing pressure is disposed in the first disc receiving chamber 60 at seat 56 and a second disc 82 having an upwardly convex surface configuration at pressures below a second, higher pressure level with respect to increasing pressure is disposed in the second disc receiving chamber 78 at seat 76.

Converter 74 is recessed at 84 to permit disc 82 to snap through to its opposite downwardly convex configuration upon the occurrence of preselected conditions.

Discs 80 and 82 are formed of a spring material such as stainless steel or a thermostat bimetal or the like which are adapted to move between original and inverted configurations in response to the occurrences of selected pressure or temperature conditions or the like in a conventional manner.

A metallic pressure divider and support ring 86 is placed on the bottom edge of wall 72 with a flexible diaphragm 88 of Teflon coated Kapton or the like disposed over the opening in ring 86.

A cup shaped metallic shell 90 has a bottom wall 92 and is preferably deep drawn to form a depending side wall 94 with a gasket receiving channel 96 formed in bottom wall 92 adjacent the outer periphery of the shell. An annular stop surface 98 is also formed in bottom wall 92 for a purpose to be described below. A gasket 100 such as a suitable, compressible "O" ring is placed in channel 96 and shell 90 is placed over diaphragm 88, ring 86 support 62 and member 50 and is drawn against these elements to compress gasket 100 a selected amount determined by the location of stop surface 98. The upper distal end of depending wall 94 is crimped over a flange 12.1 of base 12 in a conventional manner.

A suitable orifice 102 is provided in bottom wall 92 so that the switch can be placed in position to monitor the pressure of a fluid at a desired location.

When used in the application referenced supra of an automotive air conditioning refrigeration compressor operation is permitted only when the high side pressure is between first and second pressure levels of increasing pressure and between third and fourth pressure levels of decreasing pressure. Disc 80 is selected so that it will invert its configuration from that shown in FIG. 1 to its opposite configuration as shown in FIG. 2 at a first pressure level with increasing pressure, for example 50 psi. Disc 80 can be of the type which inverts its configuration with snap action or, if desired, if a narrower differential pressure is preferred (i.e., the difference in pressure between the pressure at which it moves from FIG. 1 to FIG. 2 configurations and the pressure at which it moves back from FIG. 2 to FIG. 1 configurations) a disc which is formed to exhibit less snap action can be employed. In any event disc 80 will invert to its original configuration on decreasing pressure at a somewhat lower level, for example 40 psi.

Disc 82 is selected, on the other hand, so that it will invert from its FIGS. 1 and 2 configuration to its opposite configuration as shown in FIG. 3 at a second, higher pressure with increasing pressure, such as 430 psi. Preferably disc 82 is chosen to move between its configurations with snap movement. On decreasing pressure disc 82 will invert to its original configuration at a somewhat lower level relative to its actuation level on increasing pressure, for example 200 psi.

FIG. 1 depicts the switch when the fluid in communication with orifice 102 is less than 50 psi starting from essentially 0 psi. Upward movement of diaphragm 88 and pressure converter 74 is limited by disc 80 acting through motion transfer member 68 and disc 82. It will be seen that contact 40 is out of engagement with contact 42 at such pressures ensuring that if there is an inadequate freon charge, the compressor cannot be actuated.

With reference to FIG. 2, once the pressure builds up to and exceeds 50 psi the force exerted on disc 80 causes it to invert to the FIG. 2 configuration allowing converter 74 to move motion transfer pin 48 through disc 82 until contact 40 moves into engagement with stationary contact 42. This represents the normal operating condition of the system monitored by the switch wherein the contacts are maintained in engagement between the first pressure and a second higher pressure level.

As seen in FIG. 3, if the pressure builds up to a second level, then disc 82, with ridge 70 engaging the upper surface of the disc causes the disc to invert to its upwardly concave configuration thereby allowing the normal bias of movable spring arm 36 to move motion transfer pin 48 downwardly and allow contact 40 to move out of engagement with stationary contact 42. Thus the compressor is deactuated in the event of pressures exceeding a selected level.

Figure 5:
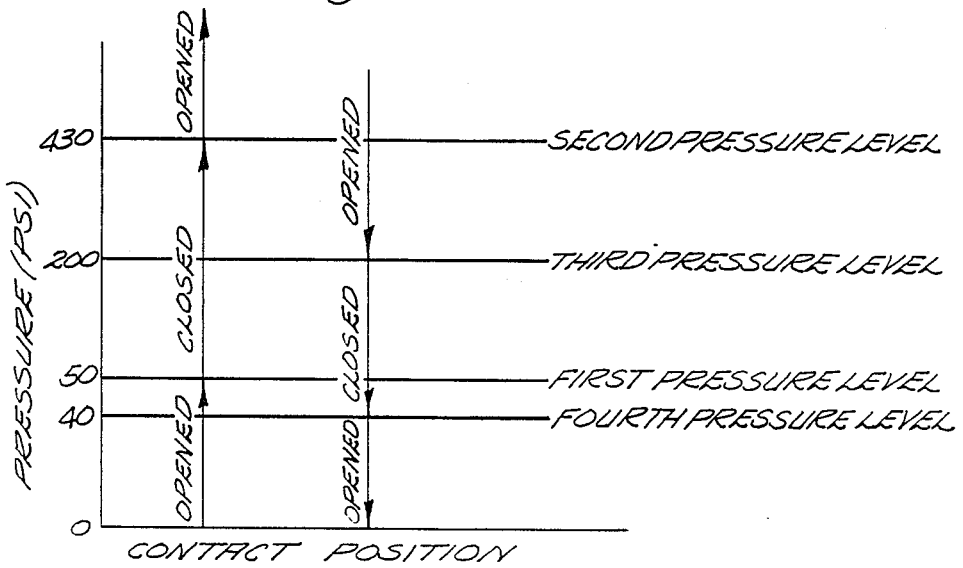
FIG. 5 is a chart showing the contacts position at various increasing and decreasing pressures.

With reference to FIG. 5 the contact positions can be determined for increasing and decreasing pressures. On pressure increase the contacts are opened until the first pressure level at 50 psi is reached with the contacts closing and remaining closed until the second pressure level at 430 psi is reached at which level the contacts open. With decreasing pressure the contacts are in the opened position until a third pressure level at 200 psi is reached with the contacts then closing and remaining closed until a fourth pressure level at 40 psi is reached with the contacts opening once again.

Figure 4:
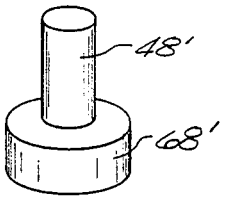
FIG. 4 is a perspective view a stepped motion transfer member which may be used in the FIGS. 1–3 embodiment.

Although motion transfer members 48 and 68 are shown as separate members they may be formed integrally, if preferred, as shown in FIG. 4 in which a stepped member comprises a first diameter portion 48' and a second large diameter portion 68'.

Figure 6:
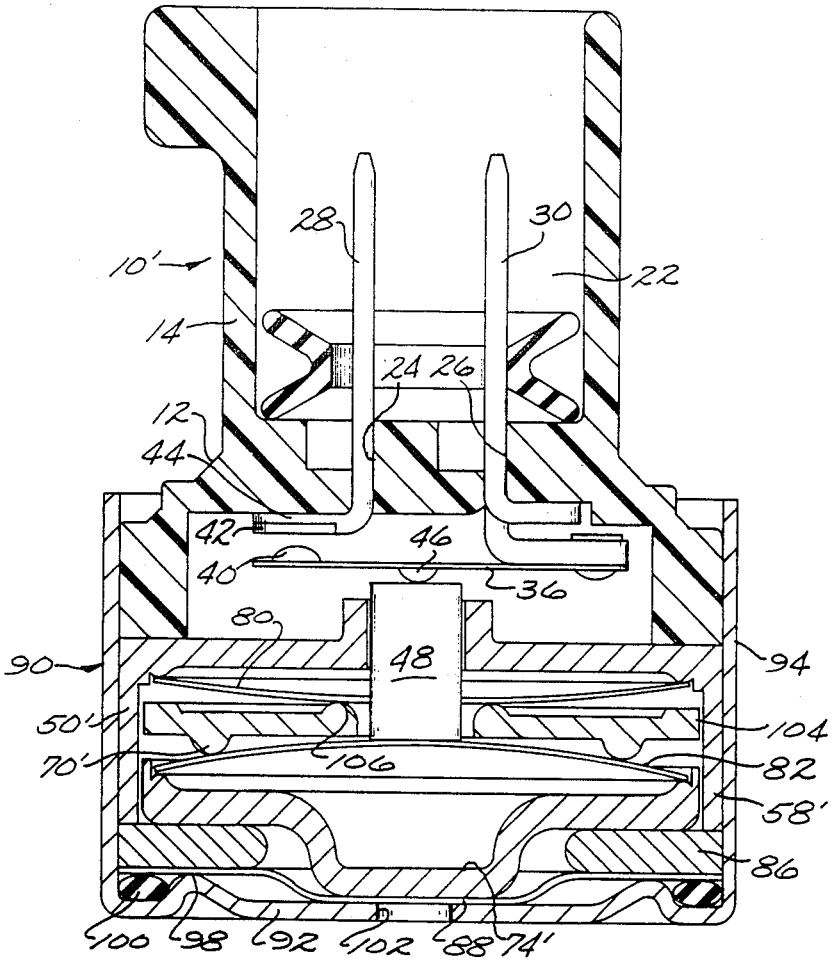
FIG. 6 is a sectional view similar to FIG. 1 of an alternative embodiment of the invention.

An alternate embodiment of the dual condition responsive device is shown in FIG. 6. In that embodiment the base and switch portions as well as the shell 90, ring 86 and gasket 100 are the same as in FIGS. 1-3 and need not be redescribed.

The first disc element support and motion transfer pin guide member 50' has been modified to extend its side wall 58' so that it extends all the way to support ring 86. An amplifier ring 104 is interposed directly between discs 80 and 82 and is free to move vertically along wall 58'. Amplifier ring 104 is formed with an annular ridge 70' on its bottom surface adjacent its outer periphery which corresponds to ridge 70 on support 62 of FIGS. 1-3. On its upper surface a ridge 106 is formed around its central bore. Pressure converter 74' is functionally the same as converter 74 in FIGS. 1-3 but is shown as a stamped part.

As pressure increases up to the first pressure level, disc 80 prevents upward movement of converter 74' through amplifier ring 104 via ridges 106 and 70' and disc 82. Once the first level of pressure is reached on increasing pressure disc 80 inverts to an upwardly convex configuration allowing converter 74' and disc 82 to move inwardly biasing pin 48 toward contact arm 36 and causing contact 40 to move into engagement with stationary contact 42. Further increase of pressure up to and above the second pressure level results in disc 82 inverting to an upwardly concave configuration through the reaction of the ridge 70' which then allows movable arm 36 to move pin 48 and movable contact 40 away from stationary contact 42.

It will be seen that decreasing pressures causes the opposite sequence of closing and reopening of the contacts at specific pressure levels determined by the differential of discs 80 and 82.

Figure 7:
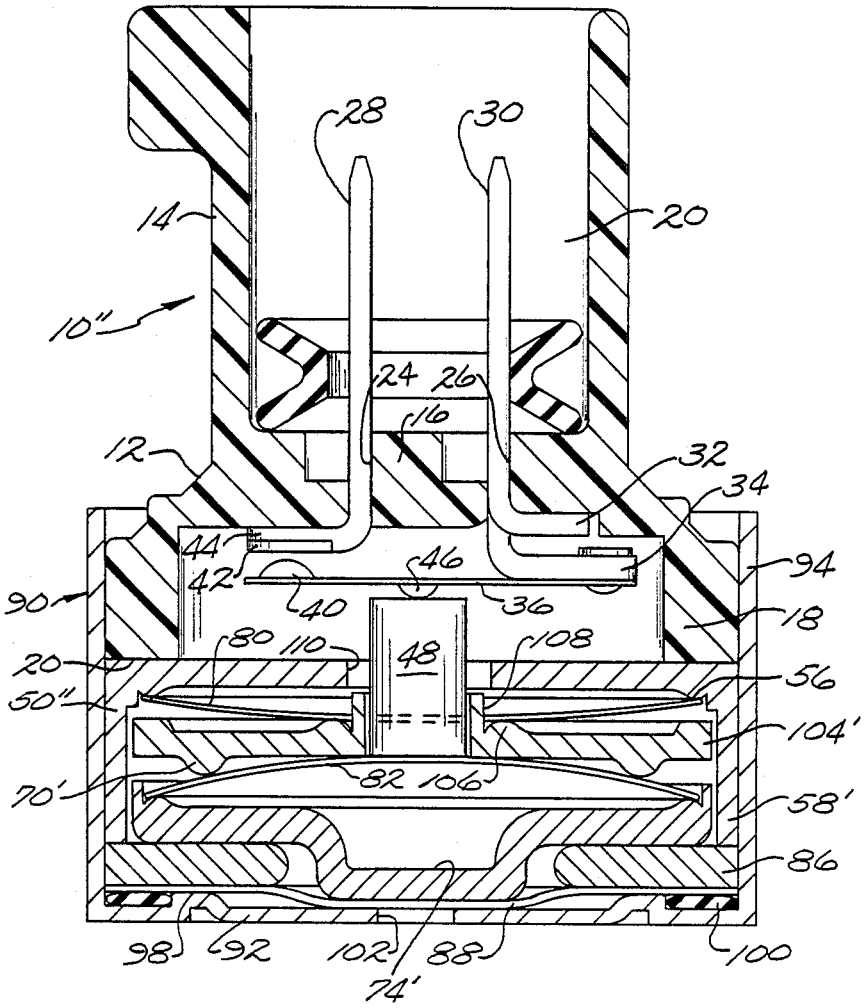
FIG. 7 is a sectional view similar to FIG. 6 of a modification of the FIG. 6 embodiment.

FIG. 7 shows a modification 10" of the FIG. 6 embodiment to minimize the possibility of misalignment of the amplifier ring and associated parts as well as to reduce friction and the possibility of discontinuous motion during normal operation of the switch. As seen in the Figure amplifier ring 104' has been provided with an upstanding cylindrical wall portion 108 formed adjacent ridge 106 to act as the motion transfer pin guide. The corresponding wall 54 shown in the previous embodiments has been removed and the bore in the disc element support 50" enlarged as seen at 110 to accommodate wall portion 108 to move freely therethrough. The outer diameter of cylindrical wall portion 108 serves to laterally locate the amplifier ring relative to the disc element support 50" through disc 80 whose centrally disposed aperture file about the cylindrical wall portion. This ensures that amplifier ring 104' is maintained out of contact with wall 58' of disc element support 50".

Figure 8:
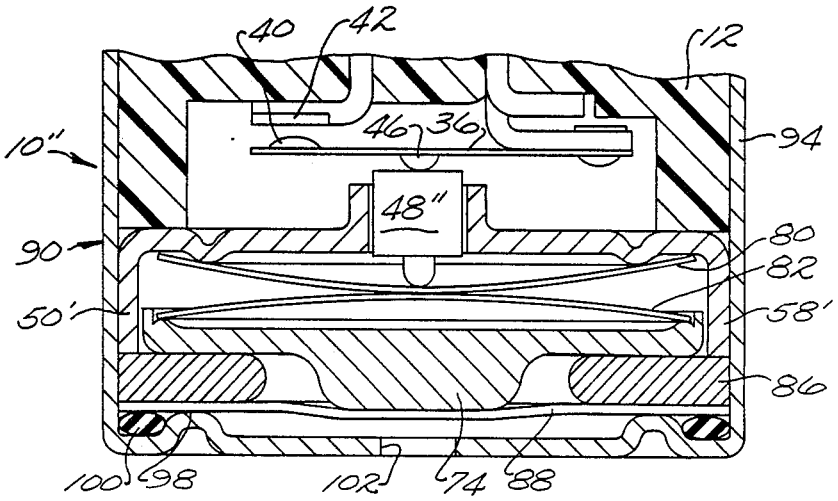
FIG. 8 is a sectional view of a portion of another embodiment of the invention.

FIG. 8 shows another embodiment 10"' similar to the FIGS. 6 and 7 embodiments but having disc 80 and 82 in engagement with one another so that motion is transferred directly between the disc. In this embodiment a separate motion transfer pin 48" is still used to transfer motion to movable contact arm 36.

Figure 9:
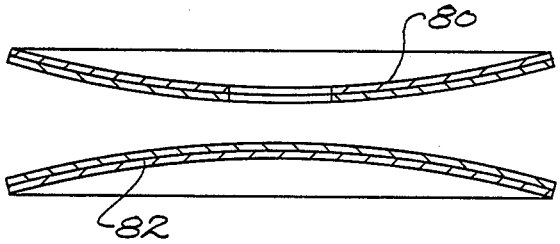
FIG. 9 shows bimetal discs which may be used in switches made in accordance with the invention.

It will be understood that the switch could also respond to temperature as well as pressure by making one or both discs out of bimetallic material as indicated in FIG. 9 so that a combination of temperature and pressure conditions could be selected to control actuation of the switch. Further, it will be realized that the switch logic could be reversed, if desired, by placing stationary contact 42 below movable contact arm 36 and biasing the contact arm in a downward direction so that at pressures below the first level and above the second level the contacts are closed and at pressures between the two levels the contacts are opened. It is also understood that the unbiased upwardly concave orientation of disc 80 and or downwardly concave disc 82 could be reversed on one or more switch embodiments.

It is within the purview of the invention to replace the movable arm by mounting the movable contact directly on the first disc if desired. Yet another variation coming within the purview of the invention is to dispose the first disc between the pressure converter and the pressure source.

It should be understood that although particular embodiments of the dual condition responsive switch of this invention have been described by way of illustrating the invention, the invention includes all modifications and equivalents of the disclosed embodiments falling within the scope of the appended claims.

What is claimed is:

1. A fluid pressure switch device closed with increasing pressure at pressure levels between first and second selected pressure levels, the second pressure level being higher than the first pressure level, and opened with increasing pressure at pressures below the first pressure level and above the second pressure level comprising a housing, an electrical switch mounted in the housing, the switch including a movable spring contact arm normally biased out of engagement with a stationary contact, first and second discs movable between convex and concave configurations and movably controlling the position of the movable contact arm, the first disc having an upwardly concave surface configuration at pressures below said first pressure level with increasing pressure disposed in a first disc receiving chamber, the second disc having an upwardly convex surface configuration at pressures below said second, higher pressure level with increasing pressure disposed in a second disc receiving chamber aligned with and beneath the first disc, a first motion transfer member slidably mounted in the housing and extending between the movable contact arm and the second disc through an aperature in the first disc, a second motion transfer member slidably mounted in the housing and extending between the first and second discs, a pressure converter having an annular disc receiving seat on one side and being adapted to slide toward and away from abutments in the second disc receiving chamber, the abutments being positioned radially inwardly relative to the annular disc receiving seat, the second disc being disposed on the disc receiving seat, a flexible membrane in engagement with an opposite side of the pressure converter, an orifice formed in the housing adapted to be placed in communication with a fluid pressure source and with the membrane, whereby with increasing pressure the first disc will limit movement of the pressure converter in a direction toward the movable contact arm through the second motion transfer member and the second disc at pressures up to the first pressure level at which level the first disc will invert to its opposite dished configuration allowing the first motion transfer member to move the movable contact arm into engagement with the stationary contact until the pressure exceeds the second pressure level with the second disc inverting to its opposite dished configuration allowing the movable contact arm to move away from the stationary contact.

2. A pressure switch device closed with increasing pressure at pressure levels between first and second selected pressures, the second pressure being higher than the first pressure, and opened with increasing pressure at pressure below the first pressure and above the second pressure comprising a housing, an electrical switch mounted in the housing, the switch including a movable spring contact arm normally biased out of engagement with a stationary contact, first and second discs movable between convex and concave configurations and movably controlling the position of the movable contact arm, the first disc having an upwardly concave surface configuration at pressures below a first pressure level with increasing pressure mounted in the housing, the disc having a centrally located aperture, the second disc having an upwardly convex surface configuration at pressures below a second pressure level with increasing pressure mounted in the housing aligned with and beneath the first disc, a motion transfer member slidably mounted extending between the movable contact arm through the aperture in the first disc and contacting the second disc, a movable member disposed between the first and second discs, a pressure converter having an annular disc receiving seat, the second disc received at the seat, a flexible membrane in engagement with an opposite side of the pressure converter, an orifice formed in the housing so that the membrane can be placed in communication with a pressure source, whereby with increasing pressure the first disc will limit movement of the pressure converter in a direction toward the movable contact arm through the movable member and the second disc at pressures up to the first pressure level at which level the first disc will invert to its opposite dished configuration allowing the motion transfer member to move the movable contact arm into engagement with the stationary contact until the pressure level exceeds the second pressure level at which level the second disc will invert to its opposite dished configuration allowing the movable contact arm to move away from the stationary contact.

3. A pressure switch according to claim 2 in which the movable member is an annular sleeve having a bore through which the motion transfer member is received.

4. A pressure switch according to claim 2 in which the movable member includes a generally flat ring having a protrusion formed on one side adjacent the bore of the ring adapted to engage the first disc.

5. A pressure switch according to claim 4 in which an abutment is formed on an opposite side of the flat ring adjacent the periphery of the ring, the abutment being adapted to engage the second disc.

6. A pressure switch according to claim 2 in which the abutment is positioned radially inwardly relative to the the annular disc receiving seat.

7. A pressure switch according to claim 5 in which the abutment is positioned radially inwardly relative to the annular disc receiving seat.

8. A dual condition responsive device comprising a housing, an electrical switch mounted in the housing, the switch including a movable contact arm normally biased in one of two contact positions, first and second discs movable between convex and concave configurations and movably controlling the position of the movable contact arm, the first disc having a normally concave surface configuration facing the movable contact arm mounted in the housing, the second disc having a normally convex surface configuration facing the movable contact arm mounted in the housing in alignment with the first disc with the first disc provided with a centrally located bore, a motion transfer member movably mounted in the housing and extending between the second disc and the movable contact arm through the bore of the first disc, a pressure converter having an annular disc receiving seat on one side being adapted to slide in a direction toward and away from the movable contact arm, the second disc being disposed on the disc receiving seat, and diaphragm means contacting the pressure converter and placing the pressure converter in communication with a pressure source.

9. A dual condition responsive device according to claim 8 in which at least one of the discs is composed of bimetallic material.

10. A fluid pressure switch device having first and second operative states and being in the first operative state with increasing pressure at pressure levels between first and second selected pressure levels, the second pressure being higher than the first pressure level, and being in the second operative state with increasing pressure at pressures below the first pressure level and above the second pressure level comprising a housing, an electrical switch mounted in the housing, the switch including a movable spring contact arm movable between one of two operative positions relative to the stationary contact, first and second discs movable between convex and concave configurations and movably controlling the position of the movable contact arm, the first disc having an upwardly concave surface configuration at pressures below said first pressure level with increasing pressure disposed in the housing, the second disc having an upwardly convex surface configuration at pressures below said second higher pressure level with increasing pressure disposed in the housing chamber aligned with an beneath the first disc, a motion transfer member slidably mounted in the housing and extending between the movable contact arm and the second disc through an aperture in the first disc, a movable member disposed between the first and second discs, a pressure converter having an annular disc receiving seat on one side and being adapted to slide toward and away from abutment means being positioned radially inwardly relative to the annular disc receiving seat, the second disc being disposed on the disc receiving seat, a flexible membrane in engagement with an opposite side of the pressure converter, an orifice formed in the housing adapted to be placed in communication with a fluid pressure source and with the membrane, whereby with increasing pressure the first disc will limit movement of the pressure converter in a direction toward the movable contact arm through the movable member and the second disc at pressures up to the first pressure level at which level the first disc will invert to its opposite surface configuration allowing the motion transfer member to move the movable contact arm from one of its two operative positions relative to the stationary contact to its other operative position until the pressure exceeds the second pressure level with the second disc inverting to its opposite surface configuration allowing the movable contact arm to move back to its said one operative position relative to the stationary contact.

11. A dual condition responsive device comprising a housing, an electrical switch mounted in the housing, the switch including a movable contact arm normally biased in one of two contact positions, first and second discs movable between convex and concave configurations and movably controlling the position of the movable contact arm, the first disc having a normally concave surface configuration facing the movable contact arm mounted in the housing, the second disc having a normally convex surface configuration facing the movable contact arm mounted in the housing in alignment with the first disc with the first disc disposed between the movable contact arm and the second disc, a motion transfer member movably mounted in the housing and extending between the first disc and the movable contact arm, a pressure converter having an annular disc receiving seat on one side being adapted to slide in a direction toward and away from the movable contact arm, the second disc being disposed on the disc receiving seat, and diaphragm means contacting the pressure converter and placing the pressure converter in communication with a fluid pressure source.

12. A pressure switch device according to claim 1 in which the first second motion transfer members are integrally formed.

13. A pressure switch device according to claim 2 in which the discs are selected so that with decreasing pressure from a level higher than the second pressure level the movable contact arm will move into engagement with the stationary contact at a third pressure level lower than the second but higher than the first pressure level and move out of engagement with stationary contact at a fourth pressure level lower than the first pressure level.

14. A dual condition responsive device comprising a housing, an electrical switch mounted in the housing, the switch including a movable contact arm normally biased in one of two contact positions, first and second discs movable between convex and concave configurations and movably controlling the position of the movable contact arm, the first disc having a normally concave surface configuration facing the movable contact arm mounted in the housing, the second disc having a normally convex surface configuration facing and operatively connected to the movable contact mounted in the housing in alignment with the first disc with the first disc disposed between the movable contact and the second disc.

a motion transfer member movably mounted in the housing and extending between the second disc and the first disc and a pressure converter having an annular disc receiving seat on one side being adapted to slide in a direction toward and away from the movable contact, the second disc being disposed on the disc receiving seat, and diaphragm means contacting the pressure converter and placing the pressure converter in communication with a fluid pressure source.

15. A pressure switch according to claim 4 in which a cylindrical wall portion extends away from the flat ring and the bore is formed in the cylindrical wall portion, the motion transfer member slidably mounted in the bore.

16. A pressure switch according to claim 15 in which the cylindrical wall portion of the movable member is received through the centrally located aperture of the first disc to locate the movable member in a selected lateral position.

17. A pressure switch according to claim 15 in which an abutment is formed on an opposite side of the flat ring adjacent the periphery of the ring, the abutment being adapted to engage the second disc.

18. A pressure switch according to claim 17 in which the abutment is positioned radially inwardly relative to the annular disc receiving seat.

19. A pressure switch according the claim 16 in which an abutment is formed on an opposite side of the flat ring adjacent the periphery of the ring, the abutment being adapted to engage the second disc.

20. A pressure switch according to claim 19 in which the abutment is positioned radially inwardly relative to the annular disc receiving seat.

21. A pressure switch according to claim 10 in which a cylindrical wall portion extends away from the flat ring and the bore is formed in the cylindrical wall portion, the motion transfer member slidably mounted in the bore.

22. A pressure switch according to claim 21 in which the cylindrical wall portion of the movable member is received through the centrally located aperture of the first disc to locate the movable member in a selected lateral position.

23. A pressure switch according to claim 21 in which an abutment is formed on an opposite side of the flat ring adjacent the periphery of the ring, the abutment being adapted to engage the second disc.

24. A pressure switch according to claim 23 in which the abutment is positioned radially inwardly relative to the annular disc receiving seat.

25. A pressure switch according to claim 22 in which an abutment is formed on an opposite side of the flat ring adjacent the periphery of the ring, the abutment being adapted to engage the second disc.

26. A pressure switch according to claim 25 in which the abutment is positioned radially inwardly relative to the annular disc receiving seat.

* * * * *